United States Patent [19]

Nix

[11] 4,451,080

[45] May 29, 1984

[54] MOBILITY AID

[76] Inventor: Ceoma Nix, 9602 Empire Ave., Cleveland, Ohio 44108

[21] Appl. No.: 238,993

[22] Filed: Feb. 27, 1981

[51] Int. Cl.[3] ..... A47C 1/00; A45B 1/00

[52] U.S. Cl. ..... 297/4; 135/84; 272/114; 297/5

[58] Field of Search ..... 272/114, 70.1; 135/84, 135/65, 67, 68, 66; 297/4, 5; 248/155, 156, 188.5

[56] References Cited

U.S. PATENT DOCUMENTS

| | | | |
|---|---|---|---|
| 406,328 | 7/1889 | Yagn | 297/4 X |
| 671,638 | 4/1901 | Slagle | 297/4 |
| 699,932 | 5/1902 | Smith | 297/4 |
| 2,052,715 | 9/1936 | Kistemacher | 297/272 |
| 2,099,345 | 11/1937 | Olszanowski | 297/4 |
| 2,783,107 | 2/1957 | Gacht | 108/146 X |
| 3,633,967 | 11/1972 | Timmins | 135/65 X |
| 4,141,375 | 2/1979 | Tykwinski | 135/68 X |
| 4,232,896 | 11/1980 | Caldwell | 297/4 |

FOREIGN PATENT DOCUMENTS

| | | | |
|---|---|---|---|
| 561720 | 11/1957 | Belgium | 297/258 |
| 48348 | 8/1889 | Fed. Rep. of Germany | 297/258 |
| 371075 | 1/1907 | France | 135/84 |
| 125770 | 8/1949 | Sweden | 297/4 |
| 645650 | 2/1979 | U.S.S.R. | 135/68 |

*Primary Examiner*—James T. McCall

*Attorney, Agent, or Firm*—D. Peter Hochberg

[57] ABSTRACT

A mobility aid for use in conjunction with crutches or like, by a legless person or a person afflicted with paraplegia for step-like ambulation, the aid having a foot with a convex lower surface.

12 Claims, 5 Drawing Figures

MOBILITY AID

This invention pertains to mobility aids for legless persons or persons afflicted by paraplegia. More specifically, the present invention relates to an aid resembling a seat, having a single leg with a convex foot for use in ambulation in conjunction with crutches and like supporting devices.

Persons lacking legs and persons afflicted with paraplegia have traditionally been restricted to wheelchairs in order to be mobile. While wheelchairs do provide a means of movement, they offer only limited mobility. Ordinary narrow entranceways, curbs, stairs, escalators and other architectural features present barriers to wheelchairs. Only recently have efforts been begun to modify such architectural barriers to permit access by wheelchair-bound persons. Such barriers are particularly detrimental and discouraging to persons whose only handicap is lack of or lack of use of their legs.

The present invention includes a legged seat, the leg having a foot adapted for step-like movement. The aid is strapped to or otherwise appended to the user. Strap-on temporary supports, in the nature of seats or stools, for use by persons having normally functioning legs are hardly new. Such devices for use during "stoop labor", milking and attending outdoor events, date at least as far back as U.S. Pat. No. 40,301 issued to Whittlesey in 1863. Representative examples of subsequent patents on other such devices are U.S. Pat. Nos. 226,252 to Smith, et al. for an Adjustable-Stool (1880), 432,560 to Ray for a Cotton Picker's Stool (1890), 2,541,483 to Rowden for a Gardener's Stool (1951), 3,306,658 to Roberts for a Contoured Body Rest (1967) and 4,232,896 to Caldwell for a Portable and Collapsible Seat (1980). None of these devices are intended to aid mobility nor are they adapted to do so. Rather, each provides to a user having normally functioning legs support in a temporary, stationary location, while permitting relocation to other such locations from time to time.

The present invention has the advantage of allowing persons without legs or without use of their legs to move with improved mobility. A further advantage of the present invention is that such persons may negotiate common architectural barriers without assistance or modification of architectural designs. Still other advantages reside in the simplicity with which the invention can be constructed, and with its small size and weight. Yet another advantage of the invention is its simplicity, economy of manufacture and ease of use.

The advantages of this invention are accomplished according to the preferred embodiments described below by a seat having one or more legs depending from it, to which are attached a foot having a convex, ground-engaging surface. The seat is fitted to the person using it by conventional straps, suspenders or other retaining means. The leg or legs support the seat so that by the use of crutches or the like three points of contact (e.g. the foot and two crutch tips) are established for a stable "standing" position. The foot has a convex ground-engaging surface. The convexity of the foot extends only from the front to rear of the foot, i.e. in the direction of movement by a person using the aid. The person using the aid may move in a linear path or along a path consisting of linear segments by rocking on the convex foot in coordination with sequential, repetitive relocation of the crutches and foot in step-like fashion. Movement is accomplished somewhat in the manner employed by a person with one useable leg and foot and employing crutches, except that the aid supplants the natural leg and foot. Rotational movement is accomplished by swiveling on the foot. By attaching the leg or legs to the seat with a lockable hinge, the user of the aid may be seated in a conventional chair without removal of the aid. To sit down, the user releases the hinge and swings the leg against the seat. Provision of a recess in the seat permits the leg or legs to be retained partially within the seat.

Further advantages of the present invention will become apparent to the skilled artisan upon examination of the detailed description of the invention taken in conjunction with the figures of drawings.

DESCRIPTION OF THE PREFERRED EMBODIMENTS

The invention will now be described with reference to certain preferred embodiments thereof. However, the skilled artisan will appreciate that such a description of preferred embodiments is intended to be illustrative only and is not to be deemed limiting.

Figure 1:
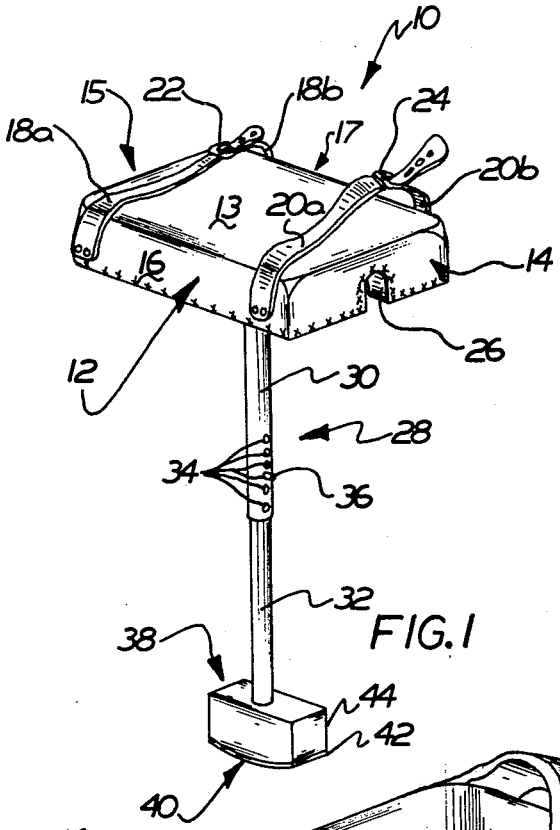
FIG. 1 is a perspective view of an embodiment of the present invention.
Figure 3:
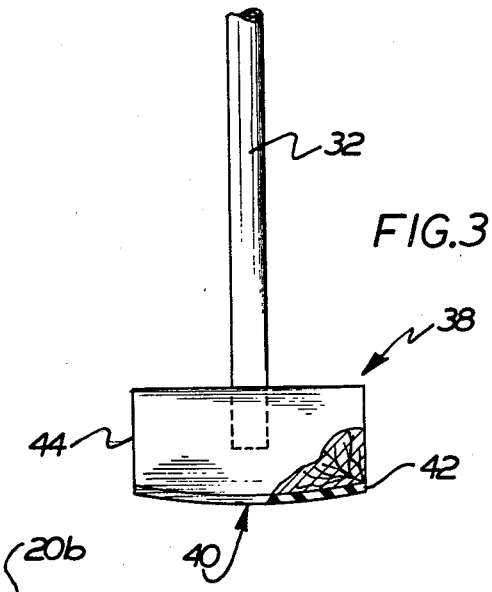
FIG. 3 is a fragmentary side view of the leg and foot portion of an embodiment of the present invention.

A preferred embodiment of the inventive mobility or walking aid 10, is shown in FIG. 1. The aid has a three dimensional seat 12 of a generally rectangular shape with a top 13 and four sides, including a front 14 and a rear 15, and lateral sides 16 and 17. Depending from lateral side 16 are straps 18*a* and 20*a*, while straps 18*b* and 20*b* depend from lateral side 17. Straps 18*a* and 18*b*, and 20*a* and 20*b*, connect, respectively, through the cooperation of buckles 22 and 24, respectively. Seat front 14 has a recess 26 open from the underside of the front and passing entirely through seat front 14. A leg 28 is substantially centrally attached to and supports seat 12 as hereinafter explained. Leg 28 consists of two telescoping sections 30 and 32. Section 30 contains a series of holes 34 along its length adapted to receive a spring biased plunger 36 projecting from section 32. As shown in detail in FIG. 3, a foot 38 is affixed at its central section to leg section 32. Foot 38 has a convex surface 40 opposite the face attached to leg section 32. The convexity of the convex foot surface extends only along the dimension of the foot lying in the direction of movement of the user of the aid. In aid 10, the surface 40 is convex along the front to rear direction, i.e. from front 14 to rear 15, but is not curved in the substantially perpendicular direction, i.e. from side 16 to side 17. Surface 40 has a renewable, resilient sole pad 42 which is joined to a permanent portion 44 of foot 38. Foot 38 can be fabricated from wood, hard plastic or rubber or the like. Pad 42 can be made from any material of the type used in the soles of shoes.

Figure 2:
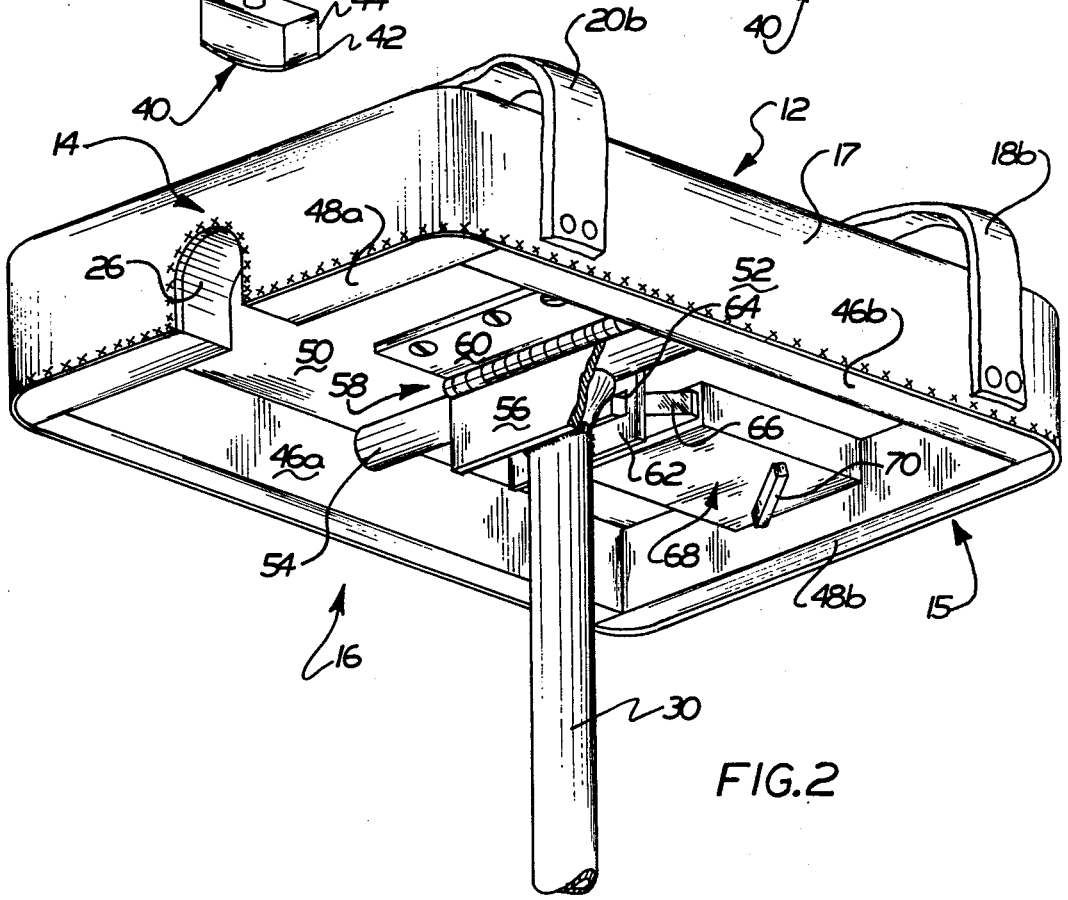
FIG. 2 is a partial perspective view from beneath of an embodiment of the present invention showing a releasable hinged attachment of the leg to the seat of the aid.

In FIG. 2, attachment of leg 28 to seat 12 of an embodiment of the invention is shown. Seat 12 is seen from beneath in FIG. 2 to include a frame having a front member 48*a*, a rear member 48*b*, side elements 46*a* and 46*b*, attached to a panel 50. Over the shell formed by the frame and panel 50 is stretched a covering 52 to form seat 12. Leg section 30 is abutted to a tube or rod 54 lying adjacent seat panel 50 and tangentially to first arm 56 of a hinge 58. A second arm 60 of hinge 58 is firmly attached to seat panel 50. The pin about which hinge arms 56 and 60 rotate is substantially perpendicular to lateral sides 16 and 17 and lies on the same side of leg section 30 as does front 14. Leg section 30 and tube 54 join along the surface of tube 54 that is opposite seat panel 50 when leg section 30 is substantially perpendicular to panel 50 to form a "T". The combination of tube 54 and leg section 30 may thus be rotated by operation of hinge 58. Tube 54 also has tangentially attached to its surface opposite hinge arm 56 a plate 62 having an aperture 64 adapted to receive a bolt 66 of a conventional latch 68. Latch 68, which is affixed to panel 50, has a release lever 70 for withdrawing, extending, releasing and locking in place bolt 66. When bolt 66 is extended and engages plate 62 through aperture 64, leg section 30 is held substantially perpendicular to seat panel 50 and seat 12. Upon release and withdrawal of bolt 66 into latch 68, leg section 30 may be swung via hinge 58 toward seat front 14. Recess 26 in front 14 is located and shaped to accept leg section 30 so that leg section 30 may be brought to a position generally adjacent to seat 50. The latch mechanism is discussed later in further detail.

The person using the aid according to the preferred embodiments buckles it to the trunk of his body with straps 18*a*, 18*b*, 20*a* and 20*b* so as to be seated on seat 12. Although the preferred embodiments employ conventional straps and buckles, other strap fasteners and adjusting means might be used such as velcro ® closures. The function of the straps is to act as a retaining means to hold the aid in a more or less fixed position relative to the body of the user. As an alternative to trunk straps, an arrangement with a belt and/or suspenders bearing on the user's shoulders may be used to retain the aid in place. However, my experience is that suspenders chafe the shoulders of the user so that the arrangement of straps shown in FIG. 1 is preferred.

Once the user of aid 10 has it strapped to him, he places leg 28 in the "walking position", i.e. to support seat 12 with foot 38 engaging the ground or floor. The user may then attain a standing position with the assistance of two conventional crutches or the like. The two crutch tips and the foot 38 provide the three points of contact with a floor essential to maintaining a stable standing position. In order to "walk", the user lifts the crutch tips from the floor and relocates them at a forward position in the desired direction of movement. Doing so causes aid 10 to rock forward on convex surface 40 of foot 38. By then thrusting downward on the crutches, the user lifts foot 38 from the floor, swings his body and aid 10 forward between the crutches, and brings convex foot 38 down near its rear edge. Thus a "step" is taken with foot 38 and leg 28 functioning as foot means and leg means, respectively for the user. By serially repeating the process of rocking and relocation, a walking sort of mobility is achieved. Turns and curvilinear movement are achieved by swiveling on foot 38 as needed while it is in contact with the floor or ground. Upon approaching a chair, a swiveling of about 180° is easily accomplished so that the user may sit down.

Proper construction of foot 38 is essential to ease of use of aid 10. The curvature of surface 40 must be only in the direction of movement. Otherwise, the side-to-side stability of aid 10 is reduced and the likelihood of the user falling is increased. Likewise, convex surface 40 must be sufficiently long from front to rear edge, for example at least four inches, or the distance and ease of making steps is reduced. If foot 38 is too short from front to rear, the possibility of snagging the edge of the foot and stumbling is increased.

The side-to-side stability of aid 10 is also affected by the rigidity with which leg 28 is held relative to seat 12 during walking. I have found that a strong metal tube or rod 54 having length approximately equal to the width of underside of seat 12 and welded to a metal leg section 30 enhances side-to-side stability. Tube 54 may be a straight tube or/rod or may be two angled pieces joined together at the upper end of leg section 30 or any other arrangement which supports seat 12 against side-to-side wiggling with respect to leg 28.

The stability, both side-to-side and front-to-rear, provided by aid 10, among other features, distinguishes it from stools, such as that disclosed by Smith, et al., in U.S. Pat. No. 226,252. Not only is the invention disclosed there solely for use of persons having normally functioning legs, it could not be used by paraplegics or legless persons even with crutches. In that disclosure, leather straps depending from a seat are relied upon to hold the foot in a relatively fixed position with respect to the seat. That arrangement would allow so much "play" in the positioning of the leg and foot that it would be impossible for a legless person to use that invention to ambulate. The swaying of a foot and leg restrained by straps would prevent the reliable coordination of crutch and foot movement necessary to achieve repetitive, stable "stepping".

The utility of aid 10 is enhanced by providing a hinging means of attachment between leg 30 and seat 12. As shown in FIG. 2, a hinge secured to the underside 50 of seat 12 and tangentially to the front side of leg section 30 allows section 30 to be swung forward. By providing recess 26 in front 14 of seat 12 adapted to accomodate leg section 30, leg 28 can be swung to a "sitting position" adjacent to underside 50 of seat 12 with recess 26 acting as a receiving means for leg section 30. A user of aid 10 can thus be seated in an ordinary chair while fitted with an aid 10. The user merely approaches a chair in the ordinary manner, swivels about 180° on foot 38, folds leg 28 toward the front of aid 10 to the sitting position and lowers himself into the seat with his crutches.

In order to obtain the essential stability of aid 10 while having the ability to fold leg 28, it is necessary to provide a releasable locking means to hold leg 28 firmly in the walking position. As shown in FIG. 2, such a mechanism may comprise a plate 62 attached to tube 54 and having an aperture 64. As discussed earlier, latch mechanism 68 attached to the underside 50 of seat 12 with a moveable bolt 66, which when extended, protrudes through aperture 64, can provide the necessary stability. Bolt 66 must fit snugly in aperture 64 when leg 28 is in the walking position as to minimize front-to-back "play" in leg 28. Actuation of lever 70 of latch 68 withdraws the bolt 66 from aperture 64 allowing leg 28 to be swung to the sitting position adjacent to seat 12. One skilled in the art will recognize that by appropriate choice of the dimensions of plate 62, bolt 66 and latch 68, the bolt can be made to engage the face of plate 62 when leg 28 is in the sitting position. Thus leg 28 may be locked in both sitting and walking positions. Alternatively, a plate may be substituted for plate 62, but mounted substantially perpendicular to, rather than face onto, leg section 30. In the walking position, leg 28 would be held steady by bolt 66 bearing directly on a face of the alternative plate.

The telescoping sections 30 and 32 which function as a leg means permit the height of a person using aid 10 to be adjusted. This adjustment is an important psychological advantage, particularly to a person who has lost legs or their function and who would otherwise be at a height below others. In FIG. 1, the height adjustment means is shown to consist of spring biased plunger 36 in leg section 32 which engages the selected one of a series of longitudinally spaced holes 34 in leg section 30. Adjustment is accomplished by depressing plunger 36 to permit the telescoping of sections 30 and 32 until the desired one of holes 34 is aligned with and engaged by plunger 36. Alternatively, one of leg sections 30 and 32 could be threaded externally and the other internally with engaging threads to allow height adjustment by relative rotation of the sections, so long as convex surface 40 of foot 38 is maintained in the proper orientation, as previously discussed.

Figure 5:
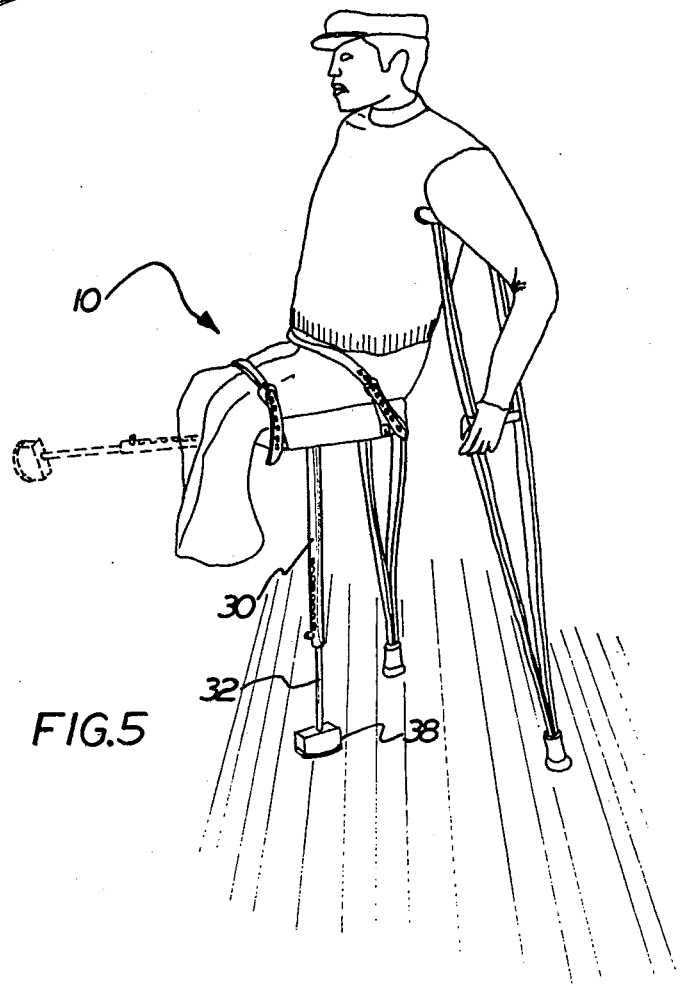
FIG. 5 is a perspective view of another embodiment of the present invention.

FIG. 5 shows aid 10 in use in the walking position in solid lines with leg 28 in sitting position shown in broken lines.

Figure 4:
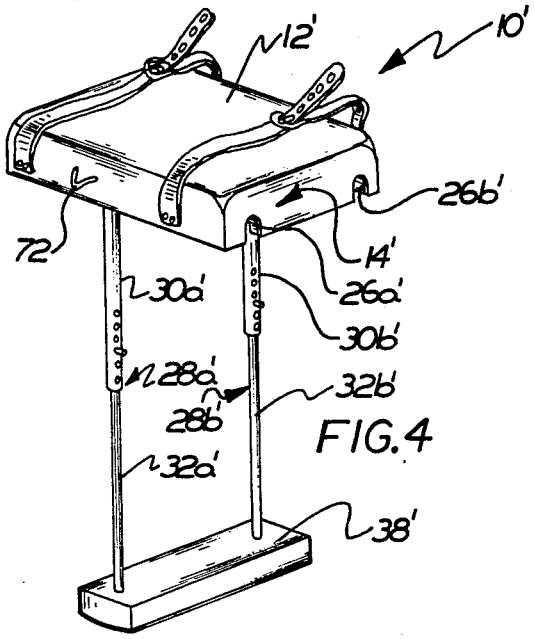
FIG. 4 is a pictorial view of the preceding embodiment when the device is in use.

Another embodiment 10' of the present invention is depicted in FIG. 4. Aid 10' has the same elements as aid 10 except as described and like parts are ascribed like numerical designations with a prime (') super-script. Two legs, **28*a*' and 28*b*', are provided in aid 10'. One leg is located near each lateral side of seat 12'. Each leg 28*a*', 28*b*' is similar to leg 30 of aid 10, having telescoping sections 30*a*', 32*a*', and 30*b*', 32*b*', respectively. Legs 28*a*' and 28*b*' are attached to a single foot 38' which is similar to foot 38 except it extends between both legs, i.e., is about as wide as seat 12'. The presence of two legs and a wider foot in aid 10' improve side-to-side stability. Front 14' of seat 12' contains recesses 26*a*' and 26*b*' to receive legs 28*a*' and 28*b*' when hinged to the sitting position. A latch handle 72 protrudes through a lateral side of seat 12' to enable release of a latch corresponding to latch 68 without the necessity of having to reach beneath seat 12'**.

Aids according to the invention are beneficial to persons lacking legs or suffering from paraplegia, but who have normal upper body muscle function. Learning to use the aid is quite swift and requires only ordinary muscular ability; only a mastery of coordinating crutches and the aid need be developed. Because the user lifts the aid once during each step, it is helpful to construct the aid from lightweight materials. Although I have been successful in using an ambulatory aid according to the invention constructed primarily of wood, with a partially metal leg, and metal stability support, hinge and latch, aluminum, plastics, and the like would be particularly useful to construct a lightweight aid. The means of joining the parts of the ambulation aid depends upon the materials selected. A single wooden seat 12 covered with a vinyl material 52 has been comfortable and shows little wear. It may be desirable to pad seat 12 and contour its shape for comfort. The only part of the aid which shows wear is sole plate 42 on the bottom of foot 38. Thus it is important that this material be renewable as well as resilient for comfort and non-skid for safety. A strip of rubber covering and nailed to a wooden permanent foot member has proven satisfactory in use.

With the aid described herein, I have been able to carry on normal activities without assistance. My activities include driving a car, riding escalators, walking city streets without concern for curbs and using revolving doors in the normal fashion. I participate at dances and am even able to climb and descend stairs unassisted.

While my invention has been described with reference to certain preferred embodiments of it, variations, omissions and additions within the spirit of the invention will be obvious to those skilled in the art. Accordingly, it is intended that the scope of the invention be limited solely by the following claims.

I claim:

1. A mobility aid for use, in conjunction with crutches or other movable supports, for step-like movement by legless persons and persons lacking supporting use of their leg or legs, comprising:

a seat;

retaining means for securing a person in said seat;

leg means attached at one end to said seat for supporting said seat above the ground; and foot means for rocking said aid at the commencement and conclusion of each step, said foot means being secured to an end of said leg means opposite the end attached to said seat, said foot means having a ground-engaging convex surface opposing said leg means, the convexity of said surface extending along the dimension of said foot lying in the direction of movement.

2. The aid of claim 1 and further comprising:

hinge means for interconnecting said leg means and said seat and for pivoting said leg means relative to said seat; and locking means for releasably locking said leg means in at least one fixed position with respect to said seat.

3. The aid of claim 2 wherein said locking means is actuable to lock said leg means in a sitting position generally parallel to said seat to aid sitting.

4. The aid of claim 3 wherein said seat includes receiving means for receiving said leg means when said leg means is in the sitting position.

5. The aid of claim 1 wherein said leg means comprises a single leg.

6. The aid of claim 1 wherein said leg means comprises two or more legs.

7. The aid of claim 1 wherein said retaining means comprises straps.

8. The aid of claim 1 wherein said leg means includes length adjusting means for adjusting the length of said leg means.

9. The aid of claim 8 wherein said leg means comprises a first leg section and a second leg section, and said length adjusting means comprises telescoping said first leg section within said second leg section.

10. The aid of claim 9 further including length fixing means for fixing said leg sections at desired lengths.

11. The aid of claim 10 wherein said length fixing means comprises a spring-biased plunger protruding from said first leg section and said second leg section includes a plurality of apertures each of which may receive said plunger.

12. The aid of claim 8 wherein said leg means comprises an externally threaded first leg section and an engaging internally threaded second leg section, and said length adjusting means comprises screwing said first leg section within said second leg section.

* * * * *